US009353749B2

(12) United States Patent
Forni

(10) Patent No.: US 9,353,749 B2
(45) Date of Patent: May 31, 2016

(54) AXIALLY COMPLIANT ORBITING PLATE SCROLL AND SCROLL PUMP COMPRISING THE SAME

(71) Applicant: AGILENT TECHNOLOGIES, INC., Loveland, CO (US)

(72) Inventor: Ronald J. Forni, Lexington, MA (US)

(73) Assignee: Agilent Technologies, Inc., Santa Clara, CA (US)

( * ) Notice: Subject to any disclaimer, the term of this patent is extended or adjusted under 35 U.S.C. 154(b) by 7 days.

(21) Appl. No.: 13/955,611

(22) Filed: Jul. 31, 2013

(65) Prior Publication Data

US 2015/0037191 A1 Feb. 5, 2015

(51) Int. Cl.

| | |
|---|---|
| ***F04C 27/00*** | (2006.01) |
| ***F04C 18/02*** | (2006.01) |
| ***F04C 29/00*** | (2006.01) |
| ***F01C 21/10*** | (2006.01) |
| ***F01C 17/00*** | (2006.01) |

(52) U.S. Cl.

CPC ..... *F04C 27/006* (2013.01); *F01C 17/00* (2013.01); *F01C 21/102* (2013.01); *F04C 18/0215* (2013.01); *F04C 27/005* (2013.01); *F04C 29/0021* (2013.01)

(58) Field of Classification Search

CPC .... F01C 19/005; F01C 21/102; F04C 27/008; F04C 28/26; F04C 18/0215; F04C 29/0021

USPC ..... 418/55.2, 55.3, 55.4, 55.5, 55.1, 57, 418/152, 153

See application file for complete search history.

(56) References Cited

U.S. PATENT DOCUMENTS

| | | | | | |
|---|---|---|---|---|---|
| 3,874,827 | A | * | 4/1975 | Young | F01C 19/08 418/151 |
| 3,884,599 | A | * | 5/1975 | Young et al. | 418/55.3 |
| 4,515,539 | A | * | 5/1985 | Morishita | 418/55.1 |
| 4,722,676 | A | * | 2/1988 | Sugimoto | 418/55.4 |
| 5,088,906 | A | * | 2/1992 | Richardson, Jr. | 418/55.2 |
| 5,106,279 | A | * | 4/1992 | Richardson, Jr. | 418/55.2 |
| 5,593,295 | A | * | 1/1997 | Hill | 418/55.2 |

(Continued)

FOREIGN PATENT DOCUMENTS

| | | |
|---|---|---|
| EP | 0732503 | 9/1996 |
| EP | 0971130 | 1/2000 |

(Continued)

OTHER PUBLICATIONS

Carvill, James. Mechanical Engineers Data Handbook. [Electronic Resource]. n.p.: Oxford ; Boston : Butterworth-Heinemann, 1993., 1994. p. 53.*

(Continued)

*Primary Examiner* — Thomas Denion
*Assistant Examiner* — Xiaoting Hu

(57) ABSTRACT

An orbiting plate scroll of a scroll pump includes an orbiting plate having a first side and a second side, an orbiting scroll blade projecting in an axial direction from the first side of the orbiting plate, and a flexure whose compliance is in the axial direction. The flexure is coupled to the orbiting plate at the second side of the orbiting plate, and couples the orbiting plate and orbiting scroll blade to bearings that allow for free rotation of the orbiting plate scroll about a longitudinal axis, while constraining motion of the orbiting plate scroll in the remaining degrees of freedom.

18 Claims, 6 Drawing Sheets

(56) References Cited

U.S. PATENT DOCUMENTS

| | | | | |
|---|---|---|---|---|
| 5,611,674 | A * | 3/1997 | Bass | F01C 21/102 417/220 |
| 6,158,991 | A * | 12/2000 | Ohtake | F04C 27/005 418/55.3 |
| 6,322,340 | B1 * | 11/2001 | Itoh et al. | 418/55.2 |
| 2003/0031576 | A1 * | 2/2003 | Fushiki et al. | 418/55.5 |
| 2005/0025652 | A1 * | 2/2005 | Kuo | 418/55.5 |
| 2012/0177523 | A1 * | 7/2012 | Won et al. | 418/55.5 |

FOREIGN PATENT DOCUMENTS

| | | |
|---|---|---|
| JP | 6380086 | 4/1998 |
| WO | WO9744585 | 11/1997 |

OTHER PUBLICATIONS

Machine Translation of WO9744585.
Search Report mailed Jan. 20, 2015 in UK Patent Application No. GB1411476.3.

* cited by examiner

AXIALLY COMPLIANT ORBITING PLATE SCROLL AND SCROLL PUMP COMPRISING THE SAME

BACKGROUND OF THE INVENTION

1. Field of the Invention

The present invention relates to a scroll pump that includes plate scrolls having nested scroll blades, and a tip seal that provides a seal between the tip of the scroll blade of one of the plate scrolls and the plate of the other plate scroll.

2. Description of the Related Art

A scroll pump is a type of pump that includes a stationary plate scroll having a spiral stationary scroll blade, and an orbiting plate scroll having a spiral orbiting scroll blade. The stationary and orbiting scroll blades are nested with a clearance and predetermined relative angular positioning such that a pocket (or pockets) is delimited by and between the scroll blades. The scroll pump also has a frame to which the stationary plate scroll is fixed and an eccentric drive mechanism supported by the frame. These parts generally make up an assembly that may be referred to as a pump head (assembly) of the scroll pump.

The orbiting plate scroll and hence, the orbiting scroll blade, is coupled to and driven by the eccentric driving mechanism so as to orbit about a longitudinal axis of the pump passing through the axial center of the stationary scroll blade. The volume of the pocket(s) delimited by the scroll blades of the pump is varied as the orbiting scroll blade moves relative to the stationary scroll blade. The orbiting motion of the orbiting scroll blade also causes the pocket(s) to move within the pump head assembly such that the pocket(s) is selectively placed in open communication with an inlet and outlet of the scroll pump.

In an example of such a scroll pump, the motion of the orbiting scroll blade relative to the stationary scroll blade causes a pocket sealed off from the outlet of the pump and in open communication with the inlet of the pump to expand. Accordingly, fluid is drawn into the pocket through the inlet. Then the pocket is moved to a position at which it is sealed off from the inlet of the pump and is in open communication with the outlet of the pump, and at the same time the pocket is collapsed. Thus, the fluid in the pocket is compressed and thereby discharged through the outlet of the pump. The sidewall surfaces of the stationary orbiting scroll blades need not contact each other to form a satisfactory pocket(s). Rather, a minute clearance may be maintained between the sidewall surfaces at the ends of the pocket(s).

A scroll pump as described above may be of a vacuum type, in which case the inlet of the pump is connected to a chamber that is to be evacuated.

Furthermore, oil may be used to create a seal between the stationary and orbiting plate scroll blades, i.e., to form a seal(s) that delimits the pocket(s) with the scroll blades. On the other hand, certain types of scroll pumps, referred to as "dry" scroll pumps, avoid the use of oil because oil may contaminate the fluid being worked by the pump. Instead of oil, dry scroll pumps employ a tip seal or seals each seated in a groove extending in and along the length of the tip (axial end) of a respective one of the scroll blades (the groove thus also having the form of a spiral). More specifically, each tip seal is provided between the tip of the scroll blade of a respective one of the plate scrolls and the plate of the other of the plate scrolls, to create a seal which maintains the pocket(s) between the stationary and orbiting scroll blades.

Scroll pumps of the type described above typically require a certain degree of axial compliance among respective ones of the parts to maintain an effective seal between the plate scrolls. One known technique of providing axial compliance is to interpose a spring between a tip seal and the blade in which the tip seal is seated. However, in the conventional art, the tip seal is constantly biased against the plate of the opposing plate scroll. Accordingly, the tip seal is continuously worn and as a result, must be replaced rather frequently. Solid plastic tip seals are known and have a relatively longer useful life than the conventional spring-biased tip seals. However, the use of solid tip seals presents its own set of problems.

SUMMARY OF THE INVENTION

An object of the present invention is to overcome one or more of the problems, disadvantages and/or limitations presented by the use of solid tip seals in scroll pump.

According to one aspect of the present invention, there is provided an orbiting plate scroll that includes an orbiting plate having a first side and a second side, an orbiting scroll blade projecting in an axial direction from the first side of the orbiting plate, and a flexure coupled to the orbiting plate at the second side of the orbiting plate, and in which the compliance of the flexure is substantially only in the axial direction.

According to another aspect of the present invention, there is provided an orbiting plate scroll for use in a scroll pump and that includes an orbiting plate having a first side and a second side, an orbiting scroll blade projecting in an axial direction from the first side of the orbiting plate, and coupling means for coupling the orbiting plate and orbiting scroll blade to bearings that allow for free rotation of the orbiting plate scroll about a longitudinal axis, and in which the coupling means is a flexure whose compliance is substantially only in the axial direction.

According to still another aspect of the present invention, there is provided a scroll pump that includes a frame, a stationary plate fixed relative to the frame, a stationary scroll blade projecting axially from the stationary plate in a direction parallel to a longitudinal axis of the pump, an orbiting plate, an orbiting scroll blade projecting axially from the orbiting plate in a direction parallel to the longitudinal axis and nested with the stationary scroll blade, a tip seal interposed between an axial end of the scroll blade of a respective one of the stationary and orbiting plate scrolls and the plate of the other of the stationary plate and orbiting plate scrolls, an eccentric drive mechanism supported by the frame and rotatably supporting the orbiting plate such that the orbiting plate can rotate about an axis of rotation parallel to the longitudinal axis, and a flexure interposed between and coupling the orbiting plate to the eccentric drive mechanism, and in which the eccentric drive mechanism is operative to drive the orbiting plate and the orbiting scroll blade extending therefrom in an orbit about the longitudinal axis, the flexure is attached to the bearings, and the compliance of the flexure is substantially only in an axial direction coincident with the axis of rotation.

BRIEF DESCRIPTION OF THE DRAWINGS

These and other objects, features and advantages of the present invention will be better understood from the detailed description of the preferred embodiments thereof that follows with reference to the accompanying drawings, in which.

DETAILED DESCRIPTION OF THE PREFERRED EMBODIMENTS

Figure 1:
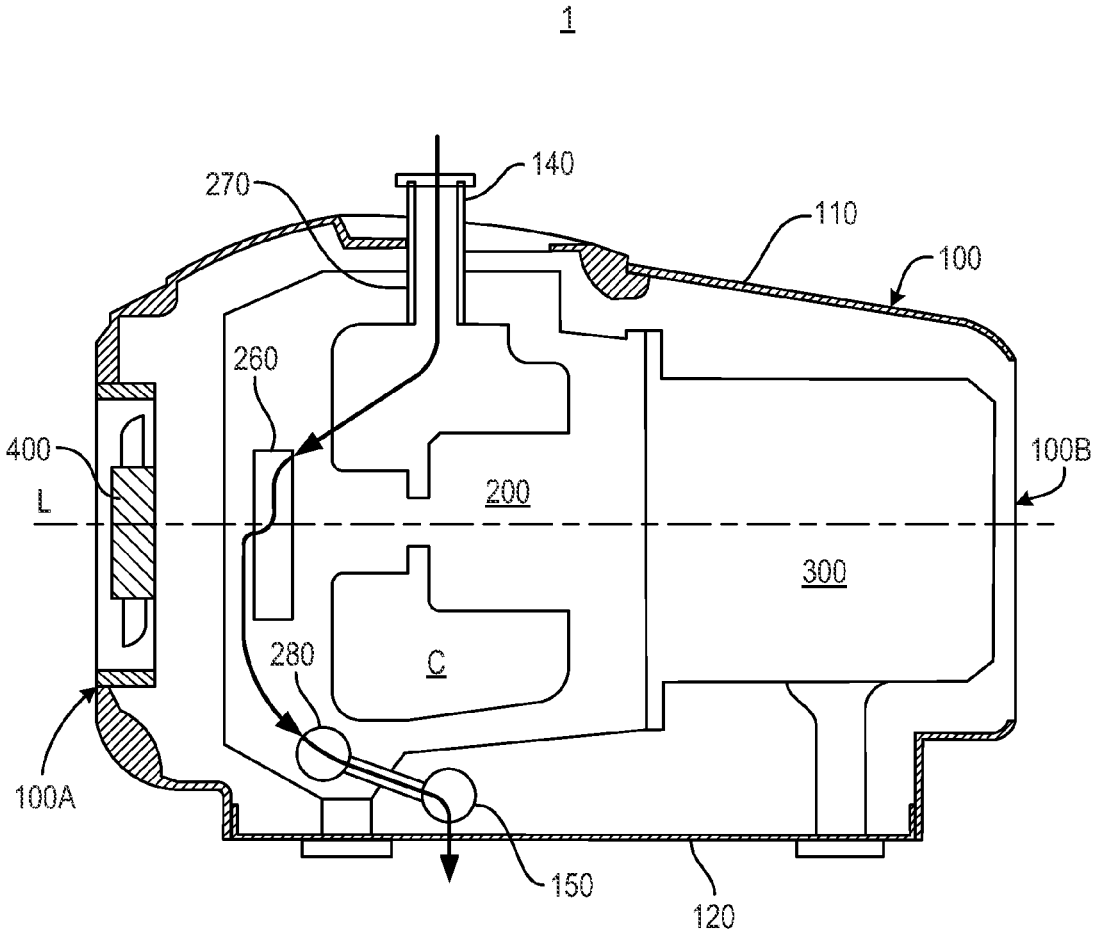
FIG. 1 is a schematic longitudinal sectional view of a scroll pump to which the present invention may be applied.

Various embodiments and examples of embodiments of the inventive concept will be described more fully hereinafter with reference to the accompanying drawings. In the drawings, the sizes and relative sizes of elements may be exaggerated for clarity. Likewise, the shapes of elements may be exaggerated and/or simplified for clarity and elements may be shown schematically for ease of understanding. Also, like numerals and reference characters are used to designate like elements throughout the drawings.

Furthermore, spatially relative terms, such as "front" and "back" are used to describe an element's relationship to another element(s) as illustrated in the figures. Thus, the spatially relative terms may apply to orientations in use which differ from the orientation depicted in the figures. Obviously, though, all such spatially relative terms refer to the orientation shown in the drawings for ease of description and are not necessarily limiting as apparatus according to the invention can assume orientations different than those illustrated in the drawings when in use.

Other terminology used herein for the purpose of describing particular examples or embodiments of the inventive concept is to be taken in context. For example, the terms "comprises" or "comprising" when used in this specification indicates the presence of stated features or processes but does not preclude the presence of additional features or processes. Terms such as "fixed" may be used to describe a direct connection of two parts/elements to one another in such a way that the parts/elements can not move relative to one another or such a connection of the parts/elements through the intermediary of one or more additional parts. Likewise, the term "coupled" may be used to describe a direct or indirect connection of two parts to one another but in such a way as to allow for some relative movement. The term "spiral" as used to described a scroll blade is used in its most general sense and may refer to any of the various forms of scroll blades known in the art as having a number of turns or "wraps". Finally, as would be readily apparent to those skilled in the art, the term "compliance" as an inherent characteristic of the flexure has a meaning similar to that of springs. That is, the term "compliance" is a vector quantity representing the direction(s) in which the flexure is compressible similar to the displacement vector of a spring. Thus, the term "the compliance of the flexure is in the axial direction" indicates that the axial direction is the direction along which the flexure will deflect as a result of an applied force, and that the motion in the noncompliant degrees of freedom will be constrained by the flexure. In the case of the present invention, that relationship or characteristic of the flexure, i.e., as represented by a force-deflection curve, may be non-linear. In particular, the flexure may comprise a Belleville spring or disc spring.

Referring now to FIG. 1, a scroll vacuum pump 1 to which the present invention can be applied may include a cowling 100, and a pump head assembly 200, a pump motor 300, and a cooling fan 400 disposed in the cowling 100. Furthermore, the cowling 100 defines an air inlet 100A and an air outlet 100B at opposite ends thereof, respectively. The cowling 100 may also include a cover 110 that covers the pump head assembly 200 and pump motor 300, and a base 120 that supports the pump head assembly 200 and pump motor 300. The cover 110 may be of one or more parts and is detachably connected to the base 120 such that the cover 110 can be removed from the base 120 to access the pump head assembly 200.

Figure 2:
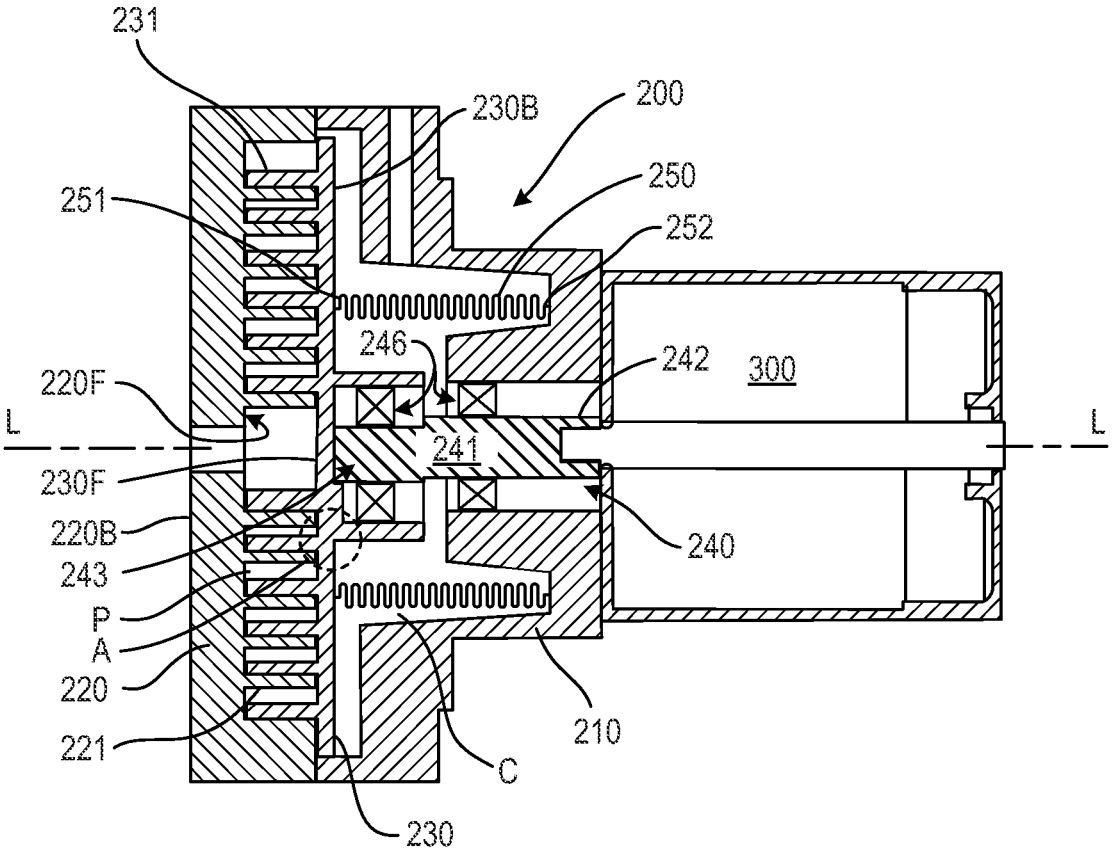
FIG. 2 is a schematic longitudinal sectional view of a pump head assembly of the scroll pump of FIG. 1.

Referring to FIG. 2, the pump head assembly 200 includes a frame 210, a stationary plate scroll 220, an orbiting plate scroll 230, and an eccentric drive mechanism 240.

The frame 210 may be one unitary piece, or the frame 210 may comprise several integral parts that are fixed to one another.

Figure 3A:
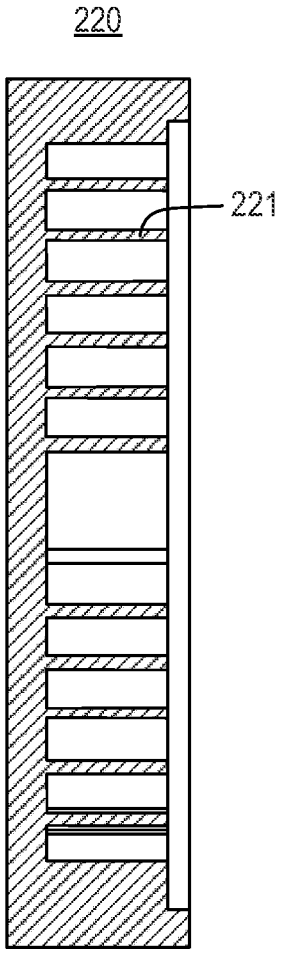
FIG. 3A is an enlarged sectional view of the stationary plate scroll of the scroll pump of FIGS. 1 and 2.
Figure 3B:
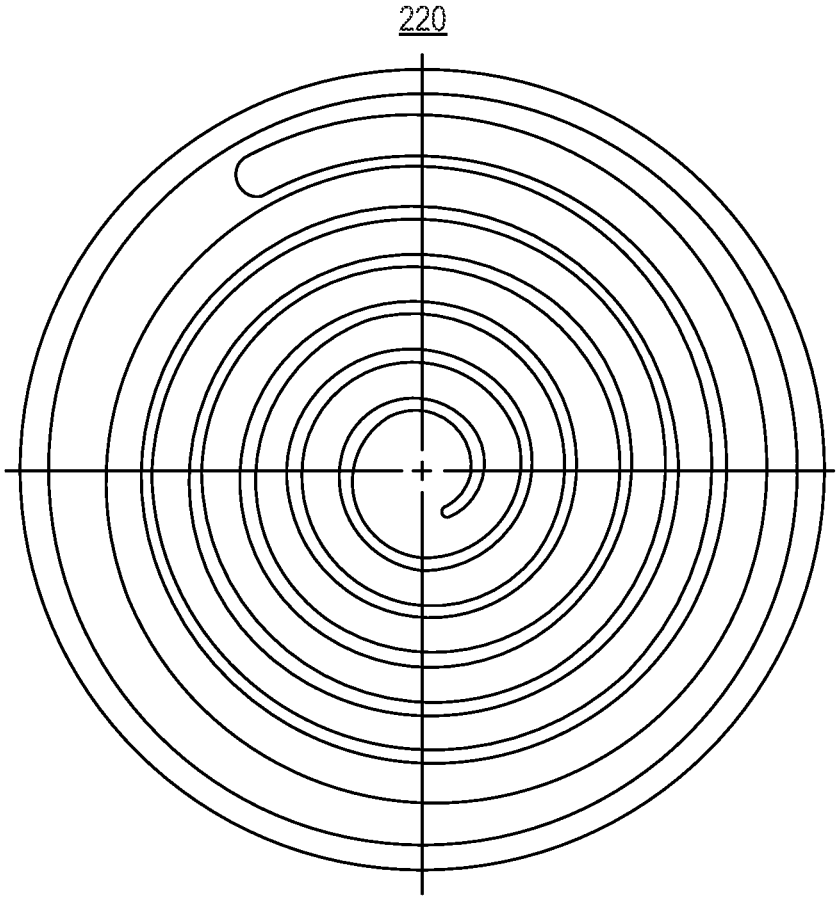
FIG. 3B is a front view of the stationary plate scroll.

The stationary plate scroll 220 in this example is detachably mounted to the frame 210. The stationary plate scroll 220 includes a stationary plate having a front (or first) side 220F and a back (or second) side 220B, and a stationary scroll blade 221 projecting axially from the front side 220F of the plate. The stationary scroll blade 221 is in the form of a spiral having a number of wraps as shown in FIGS. 3A and 3B. The orbiting plate scroll 230 includes an orbiting plate having a front (or first) side 230F and a back (or second) side 230B, and an orbiting scroll blade 231 projecting axially from the front side 230F of the plate. The orbiting scroll blade 231 has wraps that are complementary to those of the stationary scroll blade 221.

The stationary scroll blade 221 and the orbiting scroll blade 231 are nested, as shown in FIG. 2, with a clearance and predetermined relative angular and axial positioning such that pockets are delimited by and between the stationary and orbiting scroll blades 221 and 231 during operation of the pump to be described in detail below. In this respect, the sides of the scroll blades 221 and 231 may not actually contact each other to seal the pockets. Rather, minute clearances between sidewall surfaces of the scroll blades 221 and 231 along with tip seals (to be described later) create seals sufficient for forming satisfactory pockets.

The eccentric drive mechanism 240 includes a drive shaft 241 and bearings 246. In this example, the drive shaft 241 is a crank shaft having a main portion 242 coupled to the motor 300 so as to be rotated by the motor about a longitudinal axis L of the pump 100, and a crank 243 whose central longitudinal axis is offset in a radial direction from the longitudinal axis L. The bearings 246 comprise a plurality of sets of rolling elements.

Also, in this example, the main portion 242 of the crank shaft is supported by the frame 210 via one or more sets of the bearings 246 so as to be rotatable relative to the frame 210. The orbiting plate scroll 230 is mounted to the crank 243 via another set or sets of the bearings 246. Thus, the orbiting plate scroll 230 is carried by crank 243 so as to orbit about the longitudinal axis L of the pump when the main shaft 242 is rotated by the motor 300, and the orbiting plate scroll 230 is supported by the crank so as to be rotatable about the central longitudinal axis of the crank 243.

During a normal operation of the pump, a load applied to the orbiting scroll blade 231, due to the fluid being compressed in the pockets, tends to act in such a way as to cause the orbiting scroll plate 230 to rotate about the central longitudinal axis of the crank 243. However, a tubular member 250 whose ends 251 and 252 are connected to the orbiting plate scroll 230 and frame 210, respectively, and/or another mechanism such as an Oldham coupling restrains the orbiting plate scroll 230 in such a way as to allow it to orbit about the longitudinal axis L of the pump while inhibiting its rotation about the central longitudinal axis of the crank 243.

In one embodiment of the present invention, the mechanism is a tubular member 250 in the form of a metallic bellows. The metallic bellows is radially flexible enough to allow the first end 251 thereof to follow along with the orbiting plate scroll 230 while the second end 252 of the bellows remains fixed to the frame 210. Furthermore, the tubular metallic bellows has some flexibility in the axial direction, i.e., in the direction of its central longitudinal axis. On the other hand, the metallic bellows may have a torsional stiffness that prevents the first end 251 of the bellows from rotating significantly about the central longitudinal axis of the bellows, i.e., from rotating significantly in its circumferential direction, while the second end 252 of the bellows remains fixed to the frame 210. Accordingly, the metallic bellows may be essentially the only means of providing the angular synchronization between the stationary and orbiting scroll blades 221 and 231, respectively, during the operation of the pump.

The tubular member 250 also extends around a portion of the crank shaft 243 and the bearings 246 of the eccentric drive mechanism 240. In this way, the tubular member 250 seals the bearings 246 and bearing surfaces from a space defined between the tubular member 250 and the frame 210 in the radial direction and which space may constitute the working chamber C, i.e., a vacuum chamber of the pump, through which fluid worked by the pump passes. Accordingly, lubricant employed by the bearings 246 and/or particulate matter generated by the bearings surfaces can be prevented from passing into the chamber C by the tubular member 250.

Referring back to FIG. 1, the scroll vacuum pump 1 also has a pump inlet 140 and constituting a vacuum side of the pump where fluid is drawn into the pump, and a pump outlet 150 and constituting a compression side where fluid is discharged to atmosphere or under pressure from the pump. The pump head assembly 200 also has an inlet opening 270 connecting the inlet 140 of the pump to the vacuum chamber C, and an exhaust opening 280 leading to the pump outlet 150. Also, in FIG. 1, reference numeral 260 designates a compression mechanism of the pump which is constituted by the pockets defined between the stationary and orbiting plate scrolls 220 and 230.

Figure 4:
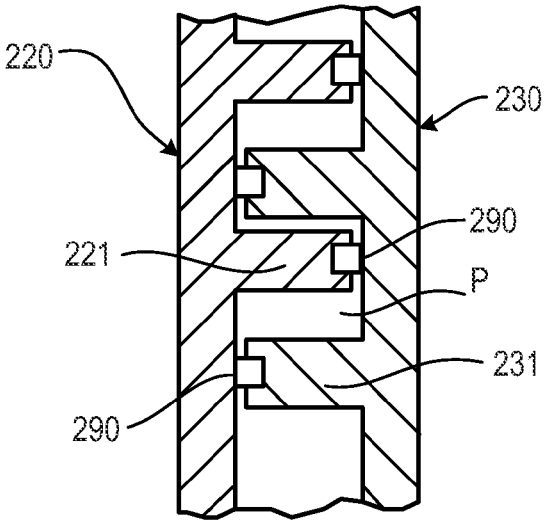
FIG. 4 is a sectional view of part of the pump head shown in FIG. 2, illustrating tip seals between the stationary plate scroll and the orbiting plate scroll.

Referring to FIG. 4, the pump head assembly 200 also has a tip seal(s) 290 that creates an axial seal between the scroll blade of one of the orbiting and stationary plate scrolls and the (floor or plate) of the other of the orbiting and stationary plate scrolls. More specifically, the tip seal 290 is a solid plastic member seated in a groove in and running the length of the tip of the scroll blade 221, 231 of one of the stationary and orbiting plate scrolls 220, 230 so as to be interposed between the tip of the scroll blade 221, 231 and the plate of the other of the stationary and orbiting plate scrolls 220, 230. FIG. 4 shows solid plastic tip seals 290 associated with both of the scroll blades 221, 231, respectively. Also, in FIG. 4, reference character P designates an arbitrary one of the above-mentioned pockets.

A scroll vacuum pump 1 having the structure described above operates as follows.

The orbiting motion of the orbiting scroll blade 221 relative to the stationary scroll blade 231 causes the volume of a lead pocket P sealed off from the outlet 150 of the pump and in open communication with the inlet 140 of the pump to expand. Accordingly, fluid is drawn into the lead pocket P through the pump inlet 140 via the inlet opening 270 of the pump head assembly 200 and the vacuum chamber C. The orbiting motion also in effect moves the pocket P to a position at which it is sealed off from the chamber C and hence, from the inlet 140 of the pump, and is in open communication with the pump outlet 150 after one or more revolutions of the crank shaft 241. Then the pocket P is in effect moved into open communication with the outlet opening 280 of the pump head assembly 280. During this time, the volume of the pocket P is reduced. Thus, the fluid in the pocket P is compressed and thereby discharged from the pump through the outlet 150. Also, during this time (which corresponds to one or more orbit(s) of the orbiting plate scroll 230), a number of successive or trailing pockets P may be formed between the stationary and orbiting scroll blades 221 and 231 and are in effect similarly and successively moved and have their volumes reduced. Thus, the compression mechanism 260 in this example is constituted by a series of pockets P. In any case, as shown schematically in FIG. 1 by the arrow-headed lines, the fluid is forced through the pump due to the orbiting motion of the orbiting plate scroll 230 relative to the stationary plate scroll 220.

Also, by virtue of the above-described operation, the fluid flows behind the tip seals 290 and "energizes" the tips seals 290, meaning that the fluid forces the tip seals against the plates of the opposing plate scrolls. The pump may be assembled with less axial clearance than the axial height of the tip seal also forcing the tip seal against the plate of the opposing plate scroll. One resulting problem is that the heat, produced by the friction between the tip seals 290 and the plates of the opposing plate scrolls, thermally distorts parts of the scroll pump. These thermal distortions can, in turn, significantly change the relative axial position of the orbiting plate scroll 230, and potentially in a direction that causes further increases in the friction and heat. In any case, this phenomena has the potential to reduce the life of the axial seal between the stationary and orbiting plate scrolls 220 and 230, and in addition overload the bearings 246 while also decreasing the viscosity of the grease in the bearings 246 as a result of the increased temperature. Moreover, as the scroll vacuum pump is operated over the long term, the tip seals 290 become worn, eventually preventing the pump from generating a suitable level of vacuum.

Another problem with a solid tip seal is that it does not provide sufficient axial compliance because such a tip seal is relatively incompressible. However, 8,000 lbs. of force in the axial direction may be required to produce a necessary deflection of 0.001 inches in a solid plastic tip seal. This force, in addition to being exerted on the tip seal, is transmitted to the bearings (246 in FIG. 2). Accordingly, the bearings may be overloaded, and the grease overheated by the increased friction and their useful life is decreased as a result.

Still another problem is that the orbiting plate scroll must be set at a precise axial position in the pump—typically within ~0.001 inches of a reference position—to prevent the bearings from being overloaded or excessive leakage of the fluid being worked by the plate scrolls.

Figure 5:
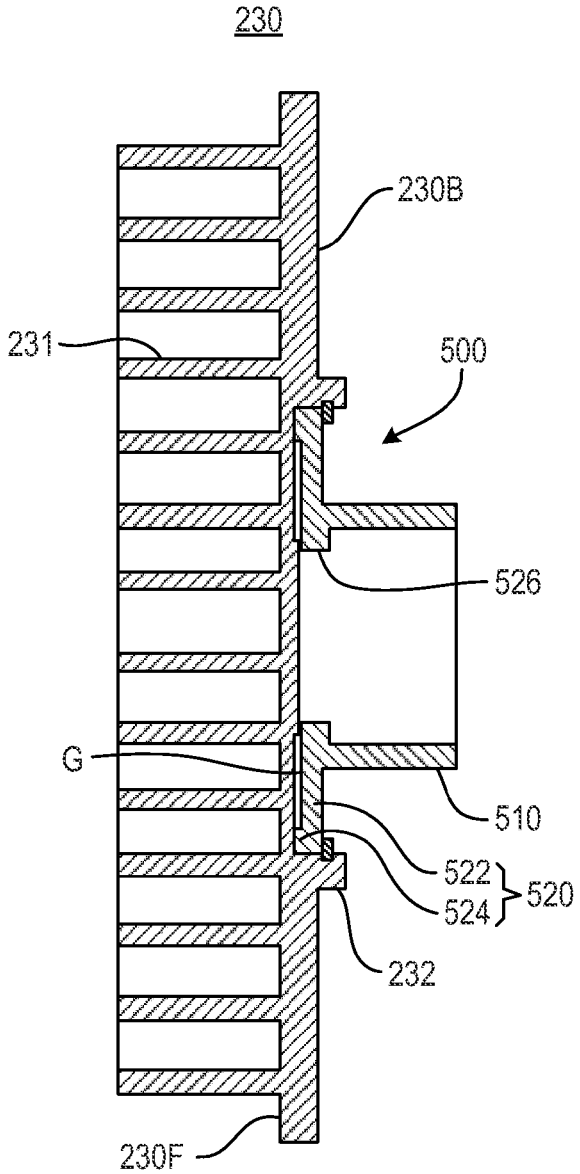
FIG. 5 is a sectional view of an orbiting plate scroll of a scroll pump according to the present invention.
Figure 6:
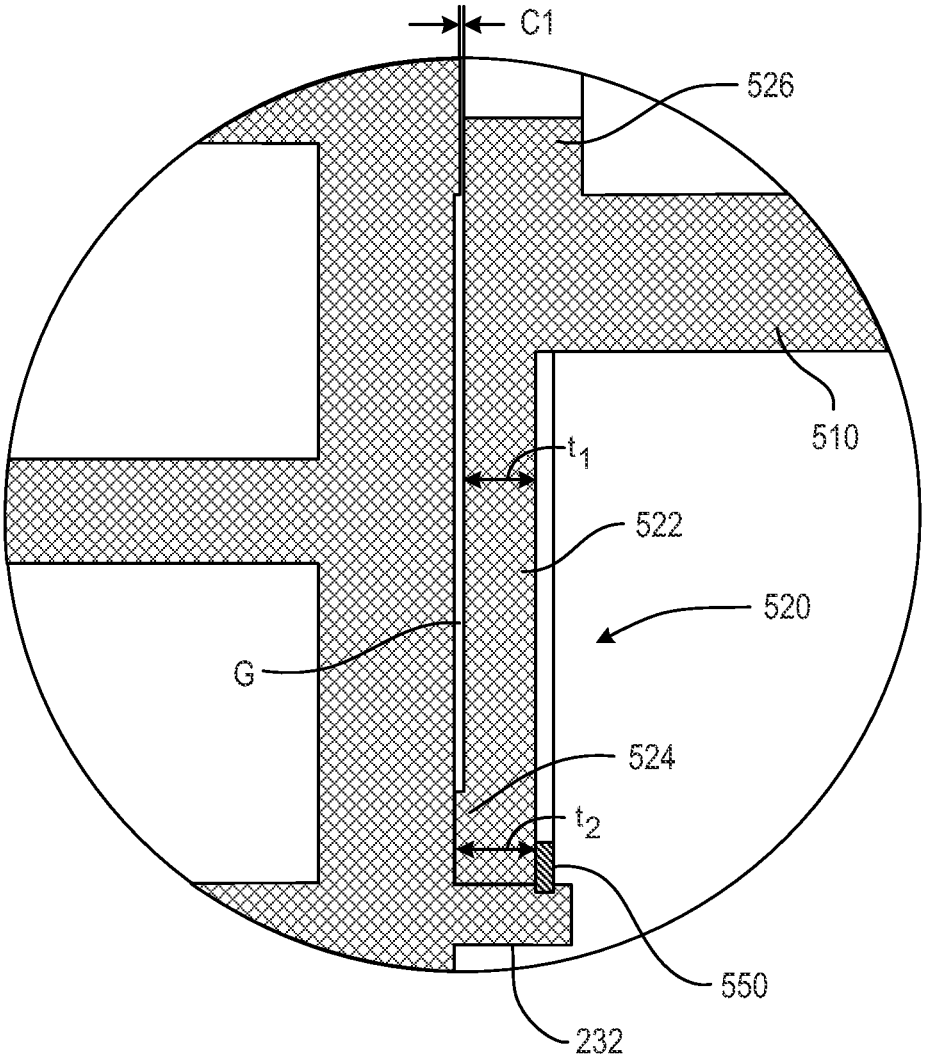
FIG. 6 is an enlarged view of a portion of the orbiting plate scroll of FIG. 5 according to the present invention, corresponding to portion A of the scroll pump of FIG. 2.

Referring to FIGS. 2, 5 and 6, the present invention provides a flexure (500 in FIG. 5) fixed to the back side 230B of the plate of the orbiting plate scroll 230, and the flexure's compliance is designed to be only in the axial direction, while providing sufficient constraints in the other 5 degrees of freedom, i.e. 2 translational and 3 rotational, so as to obviate one or more of the problems described above.

The flexure 500 includes a cylindrical hub 510 whose central longitudinal axis extends in the axial direction, and a flange 520 that extends radially from the hub 510 and connects the hub 510 to the orbiting plate. The flange 520, in turn, includes a web 522 that is spaced axially from the orbiting plate with the flexure relaxed such that a gap G exists between the web 522 and (the back side 230B of) the orbiting plate, and a union 524 integral with the web 522. The flexure 500 may be made of aluminum and may be unitary, i.e., the hub 510 and flange 520 may be unitary. A damping liquid, such as grease, may occupy the gap G between the web 522 and the second side 230B of the orbiting plate.

The union 524 is the means by which the flexure 500 is integrated with the orbiting plate. For instance, an interference fit couples the flange 520 and the orbiting plate to one another. The interference fit may be on the order of 0.002"-0.004". The interference fit may be achieved by shrink-fitting the flexure 500 to the orbiting plate scroll 230. In the illustrated example, a circular recess is provided at the back side 230B of the plate of the orbiting plate scroll 230. In this case, the circular recess is defined by an annular wall 232 of the orbiting plate scroll 230. Thus, for example, the flexure 500 may be cooled so as to shrink the outer diameter of the flange 520, the flange 520 is then inserted into the circular recess, and then the flexure 500 is allowed to return to room temperature whereupon the flange 520 expands radially outwardly into tight engagement with the annular wall 232. In addition to or in lieu of the interference fit, a retainer 550 such as an annular clip may be provided to ensure that the union 524 of the flexure 500 is fixed to the orbiting plate scroll.

In the illustrated example, the web 522 of the flexure 500 has the form of a disc, the union 524 is an annular member, and the thickness $t_1$ of the web 522 is less than the thickness $t_2$ of the union 524 in the axial direction, thereby providing the aforementioned gap G. Also, the web 522 may extend from the hub 510 to the union 524 in a direction perpendicular to the axial direction, as shown, or obliquely with respect to the axial direction.

The hub 510 is mounted to the crank 243 of the eccentric drive mechanism 240 through at least one set of bearings 246 about a longitudinal axis as shown in FIG. 2. Thus, the flexure 500 couples the orbiting plate scroll 230 to the eccentric drive mechanism 240, and the orbiting plate scroll 230 is free to rotate about a longitudinal axis coincident with that of the cylindrical hub 510, while being sufficiently constrained in the other four degrees of freedom, i.e. two translational and two rotational. The tubular structure 250, i.e. bellows, provides the rotational constraint in the third rotational degree of freedom relative to the frame 210.

The flexure 500 may also include a hard stop 526. The hard stop 526 extends radially inwardly from the hub 510. A clearance Cl exists between the hard stop 526 and (the back side 230B of) the orbiting plate 230 in the axial direction with the flexure relaxed (not deflected), and the dimension of the clearance Cl in the axial direction is less than that of the gap G between the web 522 and the orbiting plate. The purpose of the hard stop is to limit the maximum deflection of the flexure to a predetermined maximum value. Excessive deflections could potentially exceed the yield strength of the material used for the flexure resulting in a permanent deflection or possible cracking of the material.

As is clear from the description above, through proper engineering, e.g., selection of the material of the flexure 500 and the thickness $t_1$ and diameter of the web 522 of the flexure 500, and due to the gap G, the flexure 500 may deflect in the axial direction in a manner similar to that of a Belleville spring or disc spring. In an example of the present embodiment, the thickness $t_1$ is 0.110". Thus, the orbiting plate scroll 230 can be assembled with the flexure 500 slightly deflected (in a direction towards the back side 230 of the orbiting plate) by an amount necessary to exert the appropriate axial force on the tip seals 290 by which the tip seals 290 can burnish or wear themselves in against the opposing scroll plate. The appropriate axial force is one that results in a sufficient seal without damaging the tip seals 290 and bearings 246. Also, once the burnishing operation is complete and the seals 290 have worn away, the flexure 500 will no longer be providing a force on the tip seal which would reduce the life of the tip seal. At this point the only remaining axial force resulting in additional wear of the tip seals 290 is from the gas pressure underneath the tip seals.

Another consideration is that the flexure 500 should not excite noise and vibrations during operation of the scroll pump. Specifically, the natural frequency of the system that includes the flexure (Wn=Sqrt(flexure constant/mass of orbiting plate scroll)) should be tuned to avoid resonance when the pump is operating. In the event that a resonance is excited, one way to prevent excessive noise and vibration would be to provide the aforementioned damping liquid, such as grease, between the web 522 and the orbiting plate.

In addition to the advantages described above, the present invention also provides the following advantages.

Because the flexure 500 and, in particular, the web 522 of the flexure, has the form of a Belleville spring or disc spring, the flexure may naturally have a nonlinear force-deflection characteristic which will inherently result in a more or less constant force regardless of the axial deflection of the flexure 500 over at least a certain range of deflections. If such a nonlinear force-deflection characteristic is advantageous, the web 522 can be formed as a conical structure rather than a flat disc, and the particular geometry engineered to give the desired force-deflection. The reason that a nonlinear force-deflection characteristic would be advantageous is that a more or less constant flexure force during the burnishing process would reduce the wear-in time and also prevent an excessive axial force which could be produced if the flexure otherwise possessed a linear force-deflection characteristic.

Also, the flexure does not continue to "energize" the tip seals after they are worn in by an amount greater than the flexure was originally deflected in the axial direction during assembly, regardless of the force-deflection curve to which the flexure conforms, provided that the effective spring constant is greater than a critical predetermined minimum value further explained below. Accordingly, the tip seals 290 do not have to be replaced as frequently. In an example in which the present invention is applied to a conventional scroll pump, it has been found that the flexure 500 should be engineered such that the spring rate of the flexure 500 is between 30,000 lbf/inch and 6,000,000 lbf/inch. The spring constant must be greater than a predetermined minimum value so that the orbiting scroll 230 is not moved towards the stationary scroll 220 by an excessive amount as a result of the gas pressure inside the tubular structure 250, which would increase the friction on the tip seal. Likewise, the spring constant must not be greater than a predetermined maximum value which would require an excessive amount of force to deflect the flexure, also increasing the friction on the tip seal. The provision of the hard stop 526, which will engage the orbiting plate to limit the extent to which the flexure 500 deflects, will prevent damage to the flexure in case of excessive unforeseen axial loads, such as might occur if the discharge 150 of the pump is accidently blocked. In this respect, an example of an appropriate value for the clearance Cl is 0.006" although other clearances may be provided as circumstances dictate.

Furthermore, although the flexure 500 allows movement of the orbiting plate and orbiting blade in the axial direction (a Z-axis direction in a Cartesian system), the structure of the flexure 500 is designed to restrain the other five degrees of freedom of the orbiting plate and orbiting blade (translational movement along the X- and Y-axes and rotation in X-Y, X-Z and Y-Z planes). The tubular structure 250, i.e. bellows, provides the rotational constraint in the X-Y plane relative to the frame 210. The flexure 500 provides the rotational constraint in the X-Y plane between the orbiting plate 230 and the outer ring of the bearing(s) 246 fixed in the hub 510 of the flexure 500.

Finally, embodiments of the inventive concept and examples thereof have been described above in detail. The inventive concept may, however, be embodied in many different forms and should not be construed as being limited to the embodiments described above. Rather, these embodiments were described so that this disclosure is thorough and complete, and fully conveys the inventive concept to those skilled in the art. Thus, the true spirit and scope of the inventive concept is not limited by the embodiment and examples described above but by the following claims.

What is claimed is:

1. An orbiting plate scroll, comprising:

an orbiting plate having a first side and a second side;

an orbiting scroll blade projecting in an axial direction from the first side of the orbiting plate; and a flexure comprising a fixed end fixed to the orbiting plate at the second side of the orbiting plate, wherein the flexure is configured and coupled to the orbiting plate such that the compliance of the flexure is substantially only in the axial direction and at least a portion of the flexure is deflectable in the axial direction relative to the fixed end;

wherein the flexure comprises a cylindrical hub whose central longitudinal axis extends in the axial direction, and a flange that extends from the hub and connects the hub to the orbiting plate, and wherein the flange comprises a web that is spaced axially from the orbiting plate with the flexure relaxed such that a gap exists between the web and the orbiting plate, and a union integral with the web and by which the flexure is integrated with the orbiting plate at the fixed end.

2. The orbiting plate scroll of claim 1, wherein the web has the form of a disc that spans the hub and the union, the union is an annular member, and the thickness of the web in the axial direction is less than that of the union.

3. The orbiting plate scroll of claim 1, wherein the web extends from the hub to the union in a direction perpendicular to the axial direction.

4. The orbiting plate scroll of claim 1, wherein an interference fit fixes the flange and the orbiting plate to one another.

5. The orbiting plate scroll of claim 1, wherein the flexure further comprises a hard stop, a clearance exists between the hard stop and the orbiting plate in the axial direction with the flexure relaxed, and the dimension of the clearance between the hard stop and the orbiting plate in the axial direction is less than that of the gap between the web and the orbiting plate.

6. The orbiting plate scroll of claim 5, wherein the web extends radially outwardly from the hub, and the hard stop is disposed radially inwardly of the web.

7. The orbiting plate scroll of claim 1, wherein the flexure further comprises a damping liquid occupying the gap between the web and the orbiting plate.

8. The orbiting plate scroll of claim 1, wherein the flexure has a spring rate that is between 30,000 lbf/inch and 6,000,000 lbf/inch in the axial direction.

9. The orbiting plate scroll of claim 1, comprising a configuration selected from the group consisting of:

the orbiting plate comprises an annular wall projecting outward from the second side, and the fixed end is fixed to the annular wall by an interference fit;

the orbiting plate scroll comprises a retainer contacting the fixed end, wherein the fixed end is positioned axially between the retainer and the orbiting plate; and both of the foregoing.

10. The orbiting plate scroll of claim 1, wherein at least a portion of the flexure has the form of a disc spring.

11. A scroll pump, comprising:

a frame;

a stationary plate fixed relative to the frame;

a stationary scroll blade projecting axially from the stationary plate in a direction parallel to a longitudinal axis of the pump;

an orbiting plate having a first side and a second side;

an orbiting scroll blade projecting axially from the first side of the orbiting plate in a direction parallel to the longitudinal axis, and nested with the stationary scroll blade;

an eccentric drive mechanism supported by the frame and configured to drive the orbiting plate and the orbiting scroll blade to orbit about the longitudinal axis; and a flexure interposed between and coupling the orbiting plate to the eccentric drive mechanism, the flexure comprising a fixed end fixed to the orbiting plate at the second side of the orbiting plate, wherein the flexure is configured and coupled to the orbiting plate such that the compliance of the flexure is substantially only in the axial direction and at least a portion of the flexure is deflectable in the axial direction relative to the fixed end;

wherein the eccentric drive mechanism comprises a crank and at least one set of bearings mounted to the crank, and the flexure comprises a cylindrical hub mounted to the at least one set of bearings and whose central longitudinal axis extends in the axial direction, and a flange that extends from the hub and connects the hub to the orbiting plate, and wherein the flange comprises a web that is spaced axially from the orbiting plate with the flexure relaxed such that a gap exists between the web and the orbiting plate, and a union integral with the web and by which the flexure is integrated with the orbiting plate at the fixed end.

12. The scroll pump of claim 11, wherein the web has the form of a disc that spans the hub and the union, the union is an annular member, and the thickness of the web in the axial direction is less than that of the union.

13. The scroll pump of claim 11, wherein the web extends from the hub to the union in a direction perpendicular to the axial direction.

14. The scroll pump of claim 11, wherein an interference fit fixes the flange and the orbiting plate to one another.

15. The scroll pump of claim 11, wherein the flexure further comprises a hard stop, a clearance exists between the hard stop and the orbiting plate in the axial direction with the flexure relaxed, and the dimension of the clearance between the hard stop and the orbiting plate in the axial direction is less than that of the gap between the web and the orbiting plate.

16. The scroll pump of claim 15, wherein the web extends radially outwardly from the hub, and the hard stop is disposed radially inwardly of the web.

17. The orbiting plate scroll of claim 11, wherein the flexure further comprises a damping liquid occupying the gap between the web and the orbiting plate.

18. The scroll pump of claim 11, wherein the flexure has a spring rate that is between 30,000 lbf/inch and 6,000,000 lbf/inch in the axial direction.

* * * * *